US009365380B2

(12) United States Patent
Kawasaki

(10) Patent No.: US 9,365,380 B2
(45) Date of Patent: Jun. 14, 2016

(54) IMAGE FORMATION APPARATUS THAT LATERALLY SHIFTS A CONTINUOUS WEB

(71) Applicant: KONICA MINOLTA, INC., Chiyoda-ku, Tokyo (JP)

(72) Inventor: Tetsu Kawasaki, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/674,921

(22) Filed: Mar. 31, 2015

(65) Prior Publication Data

US 2015/0293484 A1 Oct. 15, 2015

(30) Foreign Application Priority Data

Apr. 11, 2014 (JP) ..... 2014-082296

(51) Int. Cl.
*B65H 23/038* (2006.01)
*G03G 15/00* (2006.01)
*B65H 23/032* (2006.01)

(52) U.S. Cl.
CPC ..... *B65H 23/038* (2013.01); *B65H 23/032* (2013.01); *G03G 15/6517* (2013.01); *B65H 2301/512125* (2013.01); *B65H 2403/942* (2013.01); *B65H 2553/416* (2013.01); *B65H 2601/272* (2013.01)

(58) Field of Classification Search
CPC ..... B65H 23/032; B65H 23/0322; B65H 23/0324; B65H 23/0326; B65H 23/0328; B65H 23/35; B65H 23/038; B65H 23/022; B65H 23/025; B65H 23/0253; G03G 15/6517; G03G 15/652; B41J 15/046
See application file for complete search history.

(56) References Cited

U.S. PATENT DOCUMENTS 6,519,441 B1 * 2/2003 Sawada ..... B41J 11/48 399/384
2015/0132016 A1 * 5/2015 Aoki ..... G03G 15/6567 399/16

FOREIGN PATENT DOCUMENTS

JP 08119503 A 5/1996
JP 2008126530 A 6/2008
JP 2012189672 A 10/2012

* cited by examiner

*Primary Examiner* — Justin Olamit
(74) *Attorney, Agent, or Firm* — Holtz, Holtz & Volek PC

(57) ABSTRACT

An image formation apparatus includes: an image formation unit that forms an image on continuous paper; a paper conveyance unit that conveys the paper through a conveyance path; a deviation correction unit that corrects deviation of the continuous paper by moving the paper on the conveyance path in a paper feed intersecting direction; a paper position measurement unit that measures a paper position in the paper feed intersecting direction of the paper on the conveyance path; and a control unit that controls the image formation unit and the deviation correction unit, wherein during stop of a conveyance operation, the control unit moves the paper to a predetermined position in the paper feed intersecting direction by deviation correction by the deviation correction unit, and during the conveyance operation, the control unit decides an image formation position in a main scanning direction in the image formation.

12 Claims, 8 Drawing Sheets

IMAGE FORMATION APPARATUS THAT LATERALLY SHIFTS A CONTINUOUS WEB

The entire disclosure of Japanese Patent Application No. 2014-082296 filed on Apr. 11, 2014 including description, claims, drawings, and abstract are incorporated herein by reference in its entirety.

BACKGROUND OF THE INVENTION

1. Field of the Invention

The present invention relates to an image formation apparatus and an image formation method for forming an image on continuous paper, and to an image formation apparatus and an image formation method that can correct the deviation of paper in a main scanning direction.

2. Description of the Related Art

For example, an image formation apparatus that performs printing with the use of continuous paper such as roll paper has been suggested. In an image formation unit of such an image formation apparatus using the roll paper, a latent image corresponding to a document is formed on a photosensitive body, toner is applied to this latent image for development, and this developed toner image is transferred to paper. After that, the toner image on the paper is fixed by a fixing unit and the paper is discharged. The roll paper is usually housed in a paper feed unit and when an image is formed, the paper is fed from the paper feed unit by a paper conveyance unit and conveyed to the image formation unit.

In this case, the paper is deviated in a main scanning direction due to the deviation of the timing of feeding the paper or the vibration or the aging of components in the conveyance of the fed paper, resulting in that the position at which the image is to be formed is displaced.

For solving the above problem, for example, JP 2008-126530 A discloses an image formation apparatus in which an end of the paper is photographed when the roll paper starts to be fed, the positional data of the end of the paper is calculated, the drawing release start position of the print data is decided on the paper based on the calculated positional data, and the position of the paper is adjusted by the inkjet head or the encoder. Moreover, JP 2012-189672 A discloses an image formation apparatus in which, if the deviation of the paper has been detected, the position where the writing of the image by the exposure unit is started is corrected and additionally, the resist rollers are shaken to move the paper conveyance position (position where the paper is conveyed in the paper width direction). Moreover, JP H8-119503 A discloses an image recording apparatus in which a difference is provided in the pressing force operating at opposite ends of a correcting roller provided across the entire width of the paper when the continuous paper is conveyed, whereby a difference is caused in the conveying force operating in the paper width direction to correct the displacement of the paper.

In the image formation apparatus according to JP 2008-126530 A, however, the deviation of the roll paper that has occurred after the drawing of the data is released is not considered and therefore if the paper position has changed in the conveyance, the image drawing position may be displaced. Moreover, in the image formation apparatus according to JP 2012-189672 A, the target is a cut sheet; therefore, the paper position cannot be changed unless the crimp throughout the conveyance path is released, and moreover, in the case of using the roll paper, the conveyance becomes difficult if the crimp is released in the conveyance of the paper. Thus, JP 2012-189672 A cannot be applied to the roll paper. In the image recording apparatus according to JP H8-119503 A, a special mechanism is necessary to correct the displacement in the paper conveyance, which costs high.

SUMMARY OF THE INVENTION

The present invention has been made in view of the above circumstances, and an object thereof is to provide an image formation apparatus and an image formation method that can prevent the image displacement due to the deviation of paper in the main scanning direction when the paper is fed, correct the change in paper position that has occurred in the paper conveyance in real time, and perform the appropriate process based on the correction result.

To achieve the abovementioned object, according to an aspect, an image formation apparatus reflecting one aspect of the present invention comprises: an image formation unit that forms an image on continuous paper; a paper conveyance unit that conveys the continuous paper through a conveyance path; a deviation correction unit that corrects deviation of the continuous paper by moving the continuous paper on the conveyance path in a paper feed intersecting direction; a paper position measurement unit that measures a paper position in the paper feed intersecting direction of the continuous paper on the conveyance path; and a control unit that controls the image formation unit and the deviation correction unit, wherein during stop of a conveyance operation of the paper conveyance unit, the control unit receives a measurement result from the paper position measurement unit and moves the paper to a predetermined position in the paper feed intersecting direction by deviation correction by the deviation correction unit based on the measurement result, and during the conveyance operation of the paper conveyance unit, the control unit receives the measurement result from the paper position measurement unit and decides an image formation position in a main scanning direction in the image formation based on the measurement result.

According to the above aspect of the present invention, even when the continuous paper such as roll paper is used, the image position correction for the deviation of the paper in the main scanning direction is conducted by correcting the paper position during the stop of the paper feeding operation and is conducted by correcting the drawing position during the paper feeding operation; thus, the accurate image formation is possible without causing the image deviation relative to the paper either during the stop of the conveyance or during the conveyance. In regard to the correction of the paper position during the stop of the image, even if the paper position has displaced in the conveyance thereafter, the correction application range can be increased by reducing the correction amount of the image formation position.

An image formation apparatus of Item. 2 is the image formation apparatus of Item. 1, wherein the paper conveyance unit is preferably provided so that a crimp conveyance unit that conveys the continuous paper while crimping the paper in the conveyance operation can release its crimp, and the control unit preferably controls to release the crimp of the crimp conveyance unit in the deviation correction in the stop of the conveyance.

According to the above aspect of the present invention, the paper position can be corrected by a deviation correction unit by enabling the release of the crimp of the crimp conveyance unit even in the conveyance operation.

An image formation apparatus of Item. 3 is the image formation apparatus of Item. 1 or 2, wherein the paper position measurement unit can preferably measure the paper position of the continuous paper in the paper feed intersecting direction periodically, and the control unit preferably predicts the paper position at image formation from a change characteristic of the paper position measured periodically in the conveyance operation of the continuous paper, and decides the image formation position in a main scanning direction in the image formation based on the predicted paper position.

An image formation apparatus of Item. 4 is the image formation apparatus of Item. 3, wherein when the paper position of the continuous paper measured periodically changes continuously in the same direction, the control unit preferably predicts the paper position of the continuous paper from an average value of a change amount of the paper position for every predetermined period, and decides the image formation position in the main scanning direction in the image formation based on the predicted paper position.

An image formation apparatus of Item. 5 is the image formation apparatus of Item. 3, wherein when the paper position of the continuous paper measured periodically does not change continuously in the same direction, the control unit preferably decides the image formation position in the main scanning direction in the image formation assuming that the current paper position is the paper position at the image formation.

An image formation apparatus of Item. 6 is the image formation apparatus of any of Items. 3 to 5, wherein when the paper position of the continuous paper measured periodically changes in paper deviating directions that very periodically, the control unit preferably predicts a timing at which the paper position of the continuous paper changes from an average value of a change amount of a conveyance distance or the paper position that changes continuously in the same direction.

According to the above aspect of the present invention, the amount of deviation of paper that periodically varies can be predicted and the image formation position can be corrected. Since the continuous paper may meander due to distortion or the like, it is considered that the changing direction is often switched at a certain period.

An image formation apparatus of Item. 7 is the image formation apparatus of any of Items. 1 to 6, wherein the control unit preferably uses an average obtained from measuring the positions a plurality of times by the paper position measurement unit as the paper position of the continuous paper relative to the paper feed intersecting direction.

An image formation apparatus of Item. 8 is the image formation apparatus of any of Items. 3 to 7, wherein the image formation apparatus further preferably comprises a storage unit that stores data related to the paper position measured by the paper position measurement unit.

An image formation apparatus of Item. 9 is the image formation apparatus of Item. 8, wherein when the continuous paper conveyed by the paper conveyance unit is exchanged, the control unit preferably clears the data related to the paper position of the continuous paper stored in the storage unit.

An image formation apparatus of Item. 10 is the image formation apparatus of Item. 8 or 9, wherein when the paper position of the continuous paper has been moved by the deviation correction during the stop of the conveyance operation, the control unit preferably clears the data related to the paper position of the continuous paper stored in the storage unit.

According to the above aspect of the present invention, the paper deviation tendency changes if the continuous paper is exchanged or the paper position is moved by the deviation correction; thus, the data representing the paper deviation tendency so far are deleted and the subsequent data are used to perform the correct position prediction.

An image formation apparatus of Item. 11 is the image formation apparatus of any of Items. 1 to 10, wherein in the conveyance operation, the control unit preferably obtains measurement data related to the paper position by the paper position measurement unit for each drawing line in the main scanning direction, averages the measurement data in a predetermined detection period based on the measured drawing line, and decides the image formation position in the main scanning direction in the image formation in accordance with the measurement data averaged for each drawing line.

According to the above aspect of the present invention, by correcting the image formation position for each line, the image formation position can be corrected quickly so as to form the image at the appropriate position on the paper.

An image formation apparatus of Item. 12 is the image formation apparatus of any of Items. 1 to 11, wherein the control unit preferably determines abnormality has occurred if the measurement data obtained by averaging based on one drawing line are greater than a predetermined reference value.

An image formation apparatus of Item. 13 is the image formation apparatus of Item. 12, wherein upon the detection of the abnormality, the control unit preferably performs at least one of stop of the operation, notification of warning to a user, and the deviation correction of the paper by the stop of the conveyance.

According to the above aspect of the present invention, it is determined that abnormality has occurred if the deviation of the paper is greater than a predetermined value, in which case at least one of the stop of the printing operation, the notification of the warning to the user, and the deviation correction of the paper by the stop of the conveyance is performed, thereby preventing the trouble or performing the recovery process. For example, by stopping the machine operation, releasing the crimp, and performing the deviation correction, it is possible to avoid the paper jam and the like and restart the appropriate printing operation quickly.

To achieve the abovementioned object, according to an aspect, an image formation method for forming an image on continuous paper, reflecting one aspect of the present invention comprises: during stop of conveyance operation of the continuous paper, measuring a paper position of a continuous paper in a paper feed intersecting direction on a conveyance path; moving the paper to a predetermined position in the paper feed intersecting direction based on a measurement result; during the conveyance operation, measuring a paper position of the continuous paper in the paper feed intersecting direction on the conveyance path; and deciding an image formation position in the main scanning direction in the image formation based on a measurement result.

According to the above aspect of the present invention, even in the case of using the continuous paper such as roll paper, the deviation of the paper in the main scanning direction can be corrected by the correction of the paper position during the stop of the conveyance operation and by the correction of the drawing position during the conveyance operation; thus, the image can be formed to the paper smoothly.

An image formation method of Item. 15 is the image formation method of Item. 14, wherein during the stop of conveyance operation of the continuous paper, the paper position measurement unit preferably measures the paper position of the continuous paper in the paper feed intersecting direction on the conveyance path, and decides the image formation position in the main scanning direction in the image formation while moving the paper to the predetermined position in the paper feed intersecting direction based on the measurement result.

An image formation method of Item. 16 is the image formation method of Item. 14 or 15, wherein the paper position measurement unit can preferably measure the paper position of the continuous paper in the paper feed intersecting direction periodically, and the control unit preferably predicts the paper position at the image formation from a change characteristic of the paper position measured periodically in the conveyance operation of the continuous paper and decides the image formation position in the main scanning direction in the image formation based on the predicted paper position.

According to the above aspect of the present invention, the paper position when the image is formed can be predicted before the start of the image formation and the drawing position can be corrected.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Figure 1:
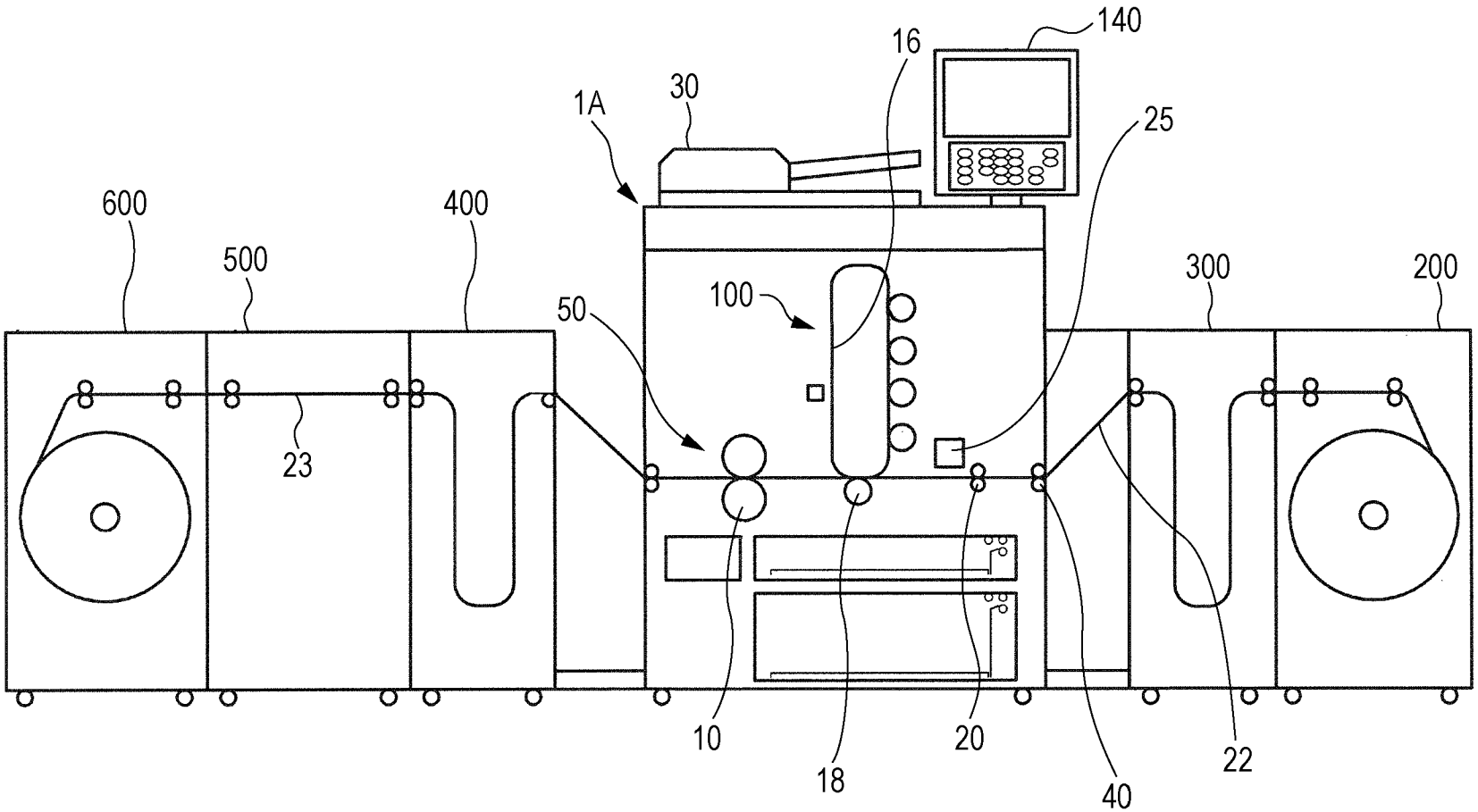
FIG. 1 is a schematic diagram showing an image formation apparatus of an embodiment of the present invention.

FIG. 1 illustrates an image formation apparatus in an embodiment of the present invention.

An image formation apparatus 1 includes an apparatus main body 1A, and a paper feed adjustment unit 300 is connected to a front stage side of the apparatus main body 1A and a paper feed unit 200 is connected to a front stage side of the paper feed adjustment unit 300. A paper discharge adjustment unit 400 is connected to a paper discharge side of the apparatus main body 1A, a process unit 500 is connected to a paper discharge side of the paper discharge adjustment unit 400, and a paper discharge unit 600 is connected to a discharge side of the process unit 500.

Note that this embodiment describes the image formation apparatus 1 is formed by the apparatus main body 1A and the devices connected to the apparatus main body 1A; however, the kind or the number of devices connected to the apparatus main body 1A are not particularly limited and the image formation apparatus may be formed by the apparatus main body 1A only.

The paper feed unit 200 has a function of housing, holding, and feeding the roll paper as the continuous paper. The paper feed adjustment unit 300 has a buffer function for absorbing the deviation and the microscopic speed difference between the paper feed unit 200 and the apparatus main body 1A. The paper discharge adjustment unit 400 has a buffer function for absorbing the deviation and the microscopic speed difference between the process unit 500 and a printer. The process unit 500 has a function of performing a posterior process such as cutting of the roll paper into a shape or the laminate process. The paper discharge unit 600 has a function of holding the discharged roll paper.

Although this embodiment employs the roll paper as the continuous paper, the continuous paper is not limited to the roll paper, and as long as the paper is continuous, the continuous slip paper, the continuous report paper, and the like may be used. The continuous paper may be provided in the form of roll paper or in the form of being folded alternately.

The image formation apparatus 1 includes an image formation unit 100 that forms an image on paper inside the apparatus main body. On the apparatus main body 1A is provided an operation display unit 140 that receives the operation of an operator and displays information. The operation display unit 140 may be configured to separately have an operation unit on which an operation is conducted and a display unit that performs the display, or to integrally have the operation unit and the display unit like a touch panel LCD.

A document reading unit 30 including an automatic document feed device that automatically reads in the document is provided on the apparatus main body 1A of the image formation apparatus 1. The image of the document is read by the document reading unit 30 and recorded once in an image memory or the like that is not shown. The read image is used in the formation of the image by the image formation unit 100.

The image formation unit 100 includes photosensitive bodies prepared for the colors (such as cyan, magenta, yellow, and black), and moreover a charger, a writing unit, and a developing unit, which are not shown, in a circumferential portion of each photosensitive body. A surface of the photosensitive body charged by the charger is subjected to image exposure by the writing unit such as an LD based on the image information of the document recorded in the image memory or the like, so that a latent image is formed on the surface of the photosensitive body. The latent image is developed by the developing unit to be a toner image. The toner image is transferred to an intermediate transfer belt 16, and the image on the intermediate transfer belt 16 is transferred to the paper conveyed by a conveyance path 22 while being crimped by a secondary transfer roller 18.

The image formation unit 100 includes a cleaning unit, which is not shown, that removes the remaining toner in contact with each photosensitive body on the rotation direction side relative to the contact position with the intermediate transfer belt 16 and on the opposite side of the rotation direction relative to the charger in accordance with each photosensitive body. Further, another cleaning unit, which is not shown, is disposed to remove the remaining toner on the intermediate transfer belt 16 on the rotation direction side relative to the paper transfer position of the intermediate transfer belt 16 and on the opposite side of the rotation direction relative to the transfer position with each photosensitive body.

Note that each photosensitive body is rotated and driven by a driving motor, which is not shown, and the intermediate transfer belt 16 is also rotated and driven by a driving motor, which is not shown.

The image formation apparatus 1 includes the conveyance path 22 ranging from the paper feed unit 200 to the paper feed adjustment unit 300 and the image formation unit 100 and further from the image formation unit 100 to the paper discharge adjustment unit 400.

The conveyance path 22 is to feed and convey the paper, and constitutes a part of the paper conveyance unit of the present invention. In the conveyance path 22, the roll paper housed in each paper feed unit 200 is fed and conveyed to the secondary transfer roller 18 through conveying rollers 40 and resist rollers 20.

The paper onto which the image has been transferred is conveyed while being crimped with fixing rollers 10 in a fixing unit 50, and by applying heat and pressure thereto, the toner image on the paper is fixed and the paper is discharged out of the apparatus in a face-up manner in the single-sided printing mode.

Note that the conveying rollers 40, the resist rollers 20, and the secondary transfer roller 18 constitute a part of a crimp conveyance unit of the present invention, and enable the crimp conveyance of the roll paper and the release of the crimp, and the crimp and release are controlled by the control unit.

The conveyance path 22 includes a resist unit on the front side in the conveying direction of the secondary transfer roller 18, and the resist unit includes a pair of upper and lower resist rollers 20. A line sensor 25 is disposed near the downstream side of the resist rollers 20 above the conveyance path 22. The position of the line sensor 25 is not limited thereto and may be disposed at any position in the paper conveyance path, and the number thereof may be more than one.

The image formation apparatus 1 includes a conveyance path 23 ranging from the paper discharge adjustment unit 400 to the process unit 500 and further from the process unit 500 to the paper discharge unit 600. The conveyance path 23 constitutes a part of the paper conveyance unit. The paper discharge adjustment unit 400 includes a buffer mechanism for absorbing the deviation and the microscopic speed difference of the roll paper between the apparatus main body 1A and the process unit 500. The paper feed adjustment unit 300 and the paper discharge adjustment unit 400 include a buffer mechanism for absorbing the deviation and the microscopic speed difference of the roll paper between the paper feed unit 200 and the paper discharge unit 600.

Figure 2:
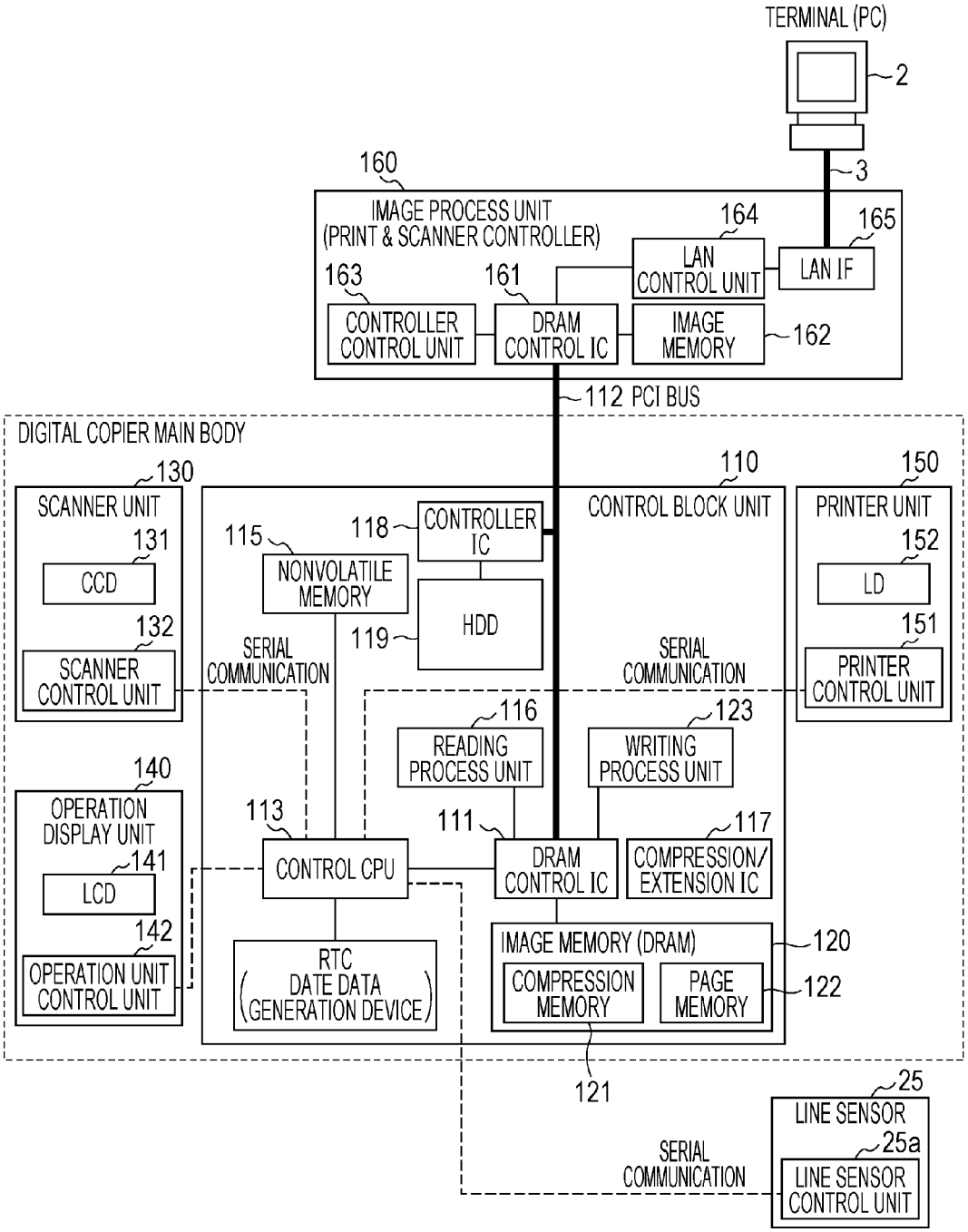
FIG. 2 is a diagram showing a control block of the image formation apparatus.

Next, FIG. 2 is a block diagram showing an electric configuration of the image formation apparatus of the present invention.

The image formation apparatus 1 includes, as a main configuration, a copier main body including a control block unit 110, a scanner unit 130, and an operation display unit 140, and a printer unit 150, and an image process unit (print & scanner controller) 160 that processes the image data input to and output from an external appliance (such as a terminal (PC) 2).

The control block unit 110 includes a PCI bus 112, and the PCI bus 112 is connected to a DRAM control IC 111 in the control block unit 110. Moreover, the control block unit 110 includes a control CPU 113, and the control CPU 113 is connected to the DRAM control IC 111. The control CPU 113 is connected to a nonvolatile memory 115. The nonvolatile memory 115 stores programs for operating the control CPU 113, the setting data of the image formation apparatus 1, process control parameters, setting data of the amount of adjusting the deviation correction depending on the paper characteristic, and the like.

The control CPU 113 controls the entire image formation apparatus 1, and knows the status of the entire image formation apparatus, and performs the image formation control, the deviation correction control, and the like. In other words, the control CPU 113 functions as a part of the control unit according to an embodiment of the present invention.

The scanner unit 130 includes a CCD 131 for performing the optical reading, and a scanner control unit 132 that controls the entire scanner unit 130. The scanner control unit 132 is connected to the control CPU 113 so that the serial communication therebetween is possible, and is controlled by the control CPU 113. Note that the scanner control unit 132 can be formed by a CPU, programs for operating the CPU, and the like. The image data read by the CCD 131 are processed in a reading process unit 116.

The operation display unit 140 includes a touch panel LCD 141 and an operation unit control unit 142, and the LCD 141 and the operation unit control unit 142 are connected to each other and the operation unit control unit 142 is connected to the control CPU 113 so that the serial communication therebetween is possible. With this configuration, the operation display unit 140 is controlled by the control CPU 113. Note that the operation unit control unit 142 can be formed by a CPU, programs for operating the CPU, and the like. To the operation display unit 140, the condition of the operation control such as the setting of the image formation apparatus or the operation order can be input, and the content of setting, the machine status, and the information can be displayed thereon. The operation display unit 140 is controlled by the control CPU 113. With this operation display unit 140, a predetermined operation and the like can be performed.

The DRAM control IC 111 is connected to an image memory 120 including a compression memory 121 and a page memory 122. The image memory stores the image data acquired by the scanner unit 130 and the image data acquired through a LAN 3. As described above, the image memory is the region storing the image data, and stores the image data of the printing job. The DRAM control IC 111 can store the image data related to the plural jobs in the image memory. In other words, the image memory can store the image data of the reserved job.

The DRAM control IC 111 is connected to a compression/extension IC 117 for compressing the image data or extending the compressed image data. Moreover, the DRAM control IC 111 is connected to a writing process unit 123. The writing process unit 123 is connected to an LD 152 of the printer unit 150, and processes the data used in the operation of the LD 152. The printer unit 150 includes a printer control unit 151 controlling the entire printer unit 150, and the printer control unit 151 is controlled by being connected to the control CPU 113. In other words, the print operation is started/stopped in accordance with the parameters applied from the control IC 113. The printer unit 150 includes the image formation unit 100 and the resist rollers 20, and the operation thereof is controlled by the control CPU 113.

The PCI bus 112 connected to the DRAM control IC 111 is connected to a DRAM control IC 161 of the image process unit (print & scanner controller) 160. In the image process unit (print & scanner controller) 160, an image memory 162 is connected to the DRAM control IC 161. Further, in the image process unit (print & scanner controller) 160, the DRAM control IC 161 is connected to a controller control unit 163, and the DRAM control IC 161 is connected to a LAN control unit 164 and a LAN interface 165. The LAN interface 165 is connected to the LAN 3.

Next, the basic operation of the image formation apparatus 1 is described.

First, the procedure of accumulating pieces of image data in the image formation apparatus 1 is described. In the case of reading the image of the document in the scanner unit 130 to generate the image data, the image of the document is optically read by the CCD 131 from the document in the scanner unit 130. In this case, the operation of the CCD 131 is controlled by the scanner control unit 132 that receives the order from the control CPU 113. The data of the image read by the CCD 131 are processed in the reading process unit 116, and the processed image data are compressed by a predetermined method in the compression/extension IC 117 and then stored in the compression memory 121 through the DRAM control IC 111. The image data stored in the compression memory 121 can be managed as a job by the control CPU 113.

In the case of acquiring the image data from the outside, for example, the image data transmitted from the terminal (PC) 2 through the LAN 3 are stored in the image memory 162 by the DRAM control IC 161 through the LAN interface 165 and the LAN control unit 164. The data of the image memory 162 are stored once in the page memory 122 through the DRAM control IC 161, the PCI bus 112, and the DRAM control IC 111. The data stored in the page memory 122 are sequentially transmitted to the compression/extension IC 117 through the DRAM control IC 111 to be compressed thereby, stored in the compression memory 121 through the DRAM control IC 111, and managed by the control CPU 113 in a manner similar to the above.

In the case of outputting the image from the image formation apparatus 1, i.e., using the apparatus 1 as a copier or a printer, the image data stored in the compression memory 121 are sent to the compression/extension IC 117 through the DRAM control IC 111 to be extended thereby, and the extended data are sent to the writing process unit 123 and written to each photosensitive body in the LD 152.

In the printer unit 150, each portion is controlled by the printer control unit 151 having received the order of the control CPU 113. In the image formation unit 100, the toner image written in each photosensitive body is transferred to the intermediate transfer belt 16 and then transferred to the roll paper supplied by the paper feed unit 200, and after that, fixed in the fixing unit 50. The paper having the image formed thereon is conveyed to the paper discharge adjustment unit 400 by the conveyance path 23 through the fixing conveying rollers, and is subjected to the posterior process in the process unit 500 on the downstream side. If there is a plurality of reserved jobs, the images are output sequentially according to the setting order. The roll paper from the process unit 500 is wound into a roll in the paper discharge unit 600.

In each photosensitive body, after the toner image is transferred to the intermediate transfer belt 16, the remaining toner is removed by each cleaning unit. Similarly in the intermediate transfer belt 16, after the toner image is transferred, the remaining toner is removed by the cleaning unit.

Next, description is made of the configuration around the resist rollers 20 on the conveyance path 22.

In the resist rollers 20, by forming a loop with an end of the roll paper conveyed in the conveyance path 22 come in contact with the rollers, the skew of the paper is corrected. In this case, the position of the paper is read by the line sensor 25 positioned right on the downstream side of the resist rollers 20. After the loop is formed at the resistor roller 20, the resist roller 20 is rotated and driven in the conveying direction in accordance with the image on the intermediate transfer belt 16, thereby conveying the roll paper toward the secondary transfer roller 18. Moreover, the crimp of the resist rollers 20 by the crimp conveyance unit can be released when the conveyance is stopped, and the roll paper can be moved (shaken) in the main scanning direction (paper feed intersecting direction) with the paper interposed therebetween. Therefore, the resist rollers 20 constitute the deviation correction unit according to an embodiment of the present invention. The shaking of the resist rollers 20 is controlled by the control CPU 113.

The configuration of the deviation correction unit in the present invention, however, is not limited to the resist rollers 20.

Figure 3:
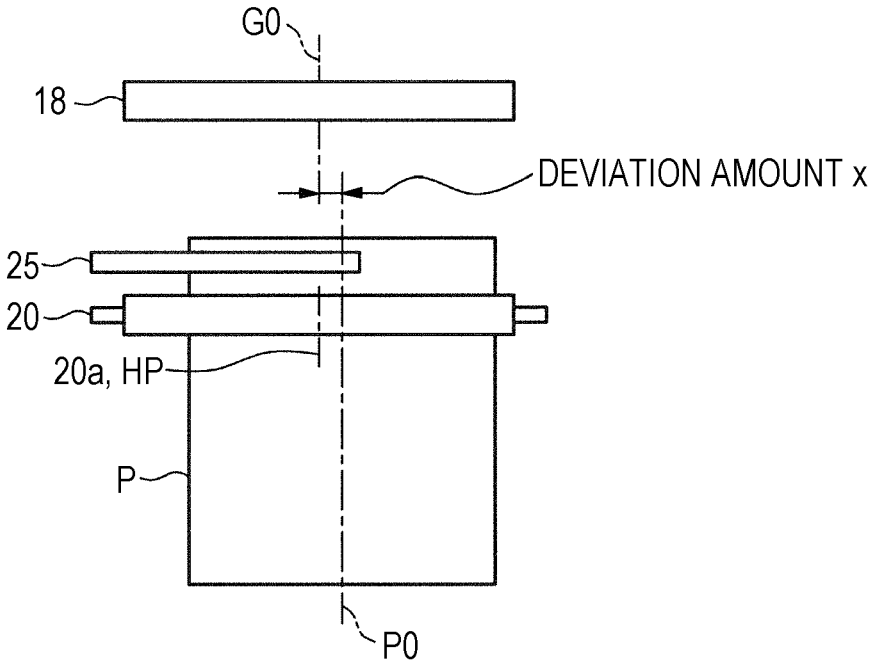
FIG. 3 is a diagram showing a state in which the paper is deviated relative to the image center.

In FIG. 3, a center 20*a* of the resist roller 20 is located at a home position HP.

Just after the conveying direction of the resist rollers 20, the line sensor 25 including the CCD sensor and the like is disposed along the main scanning direction. The line sensor 25 reads the position of the end of the roll paper in the paper feed intersecting direction and its result is transmitted to the control CPU 113 and stored once in the nonvolatile memory 115 or an HDD 119, for example. The line sensor 25 corresponds to the paper position measurement unit in this embodiment, and the nonvolatile memory 115 and the HDD 119 correspond to the storage unit that stores the measurement results of the paper position.

Note that FIG. 3 illustrates the state in which the roll paper P having reached the resist rollers 20 is deviated by a deviation amount of x relative to the home position HP.

The line sensor 25 measures the paper end in the conveying direction of the roll paper P conveyed as above, and the measurement result is transmitted to the control CPU 113. In the control CPU 113, the paper with a predetermined size is selected when the paper is fed, and the size of the paper in conveyance is known. Then, based on the paper size and the measurement result from the line sensor 25, the control CPU 113 determines the position of the center P0 of the roll paper. The control CPU 113 sets the image center G0 formed on the intermediate transfer belt 16, and in this example, the image center G0 coincides with the center line of the intermediate transfer belt 16. The control CPU 113 calculates the difference between the center P0 of the roll paper and the image center G0. This difference corresponds to the deviation amount x of the paper.

Figure 4A:
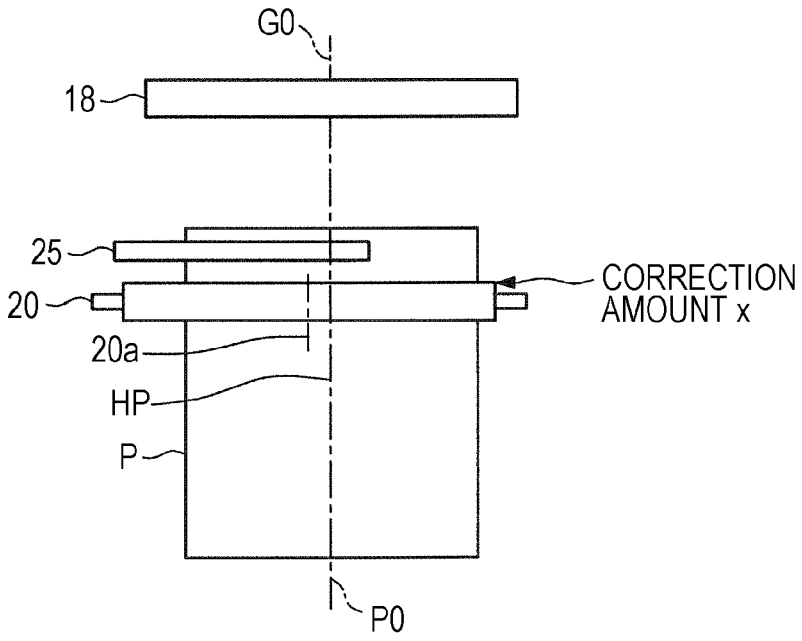
FIG. 4A is a diagram showing a state in which the paper center is aligned to the image center by the deviation correction.

FIG. 4A shows the state in which the deviation amount x of the roll paper P is corrected.

In the image formation apparatus, the control CPU 113 decides the amount of shake −x of the resist rollers 20 based on the deviation amount x so that the center P0 of the roll paper coincides with the image center G0, and then, the resist rollers 20 are shaken from the home position HP by the decided shake amount −x, thereby moving the roll paper P by the correction amount −x. This makes the image center G0 and the center P0 of the roll paper coincide with each other, and the paper sent by the resist rollers 20 is fed into the secondary transfer roller 18. Thus, the deviation in the main scanning direction of the roll paper P can be corrected and the paper can be matched with the image position. By the shake, the center 20*a* of the resist rollers 20 is positioned at a distance of −x from the home position HP.

In the above description, the image center G0 coincides with the center line of the intermediate transfer belt 16; however, the image center G0 may be set at a position different from the position of the center line.

Note that the home position HP may be set as the default or may be set after the apparatus starts the operation.

Figure 4B:
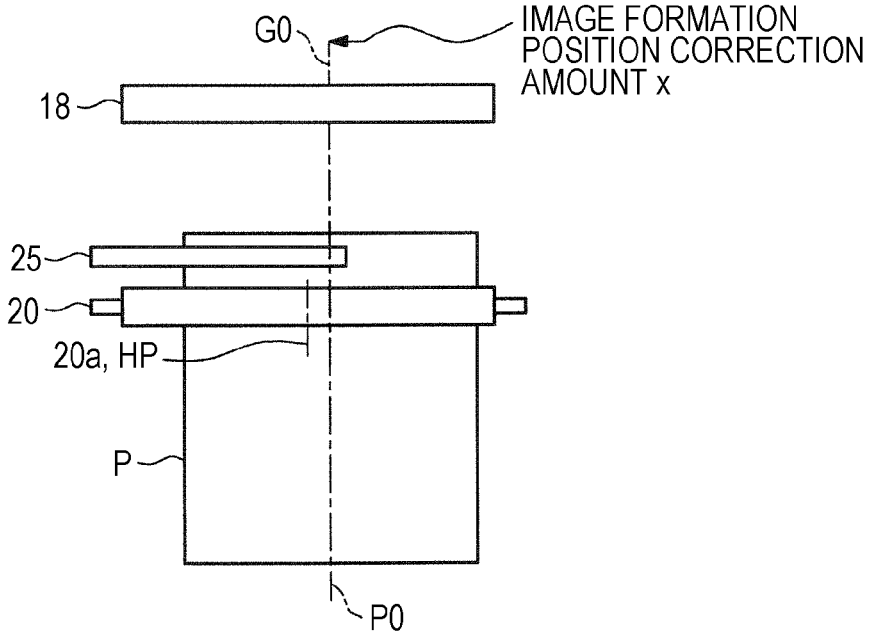
FIG. 4B is a diagram showing a state in which the image formation position is aligned to the paper center.

FIG. 4B shows the state in which the image formation position is corrected by the correction amount x.

In the image formation apparatus, the control CPU 113 moves the image formation position by the correction amount x based on the deviation amount x so that the center P0 of the roll paper coincides with the image center G0. This makes the image center G0 coincide with the center P0 of the roll paper. In this manner, the image position can be matched with the paper position in accordance with the deviation in the main scanning direction of the roll paper P.

Figure 5:
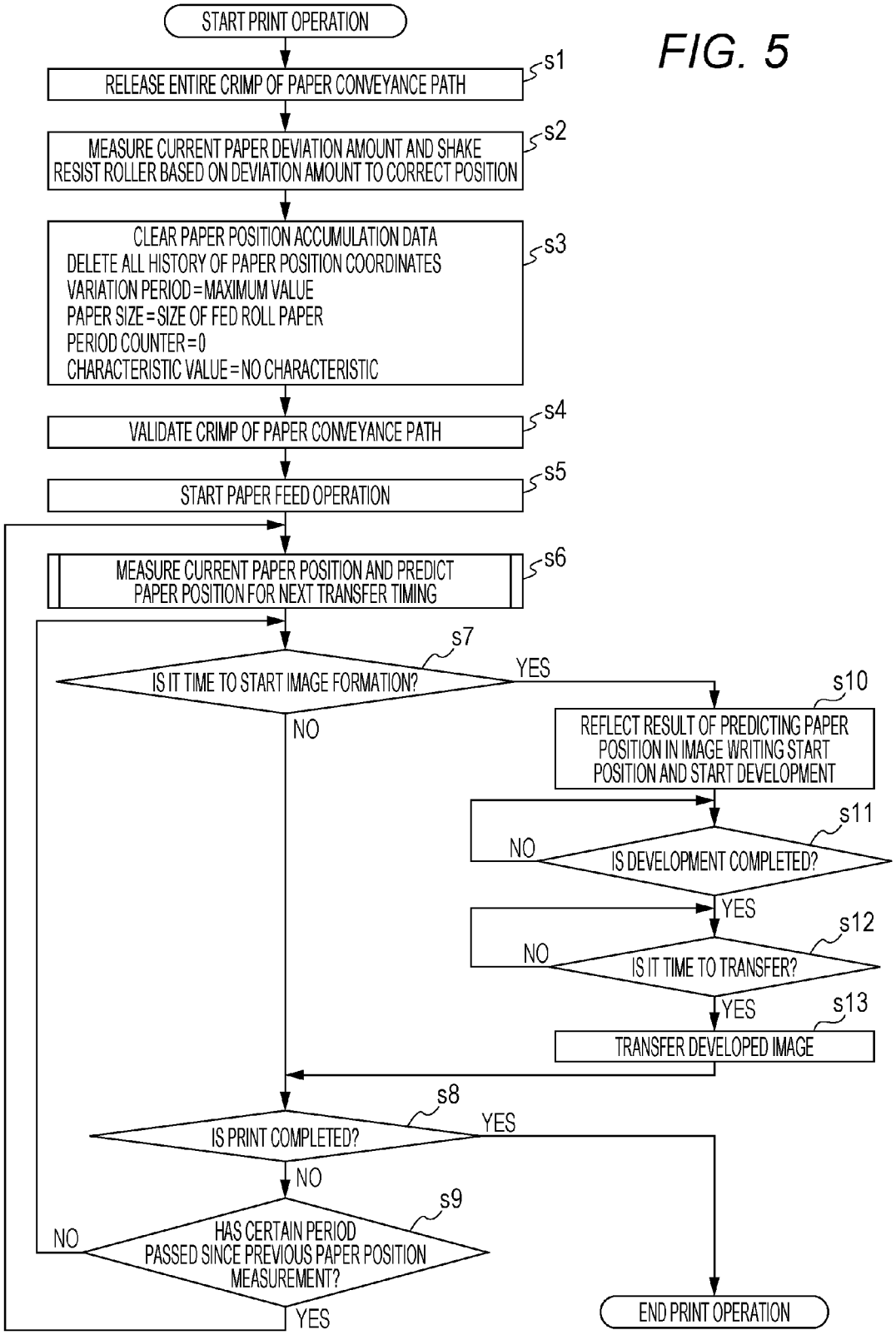
FIG. 5 is a flowchart showing the procedure of correcting the displacement of the continuous paper in the main scanning direction.

Next, the procedure of controlling the deviation correction in the paper main scanning direction is described with reference to the flowchart of FIG. 5. The procedure below is executed by the operation of the control CPU 113.

Upon the start of the print operation, the crimp of the paper by the crimp conveyance unit on the conveyance paths 22 and 23 is entirely released (Step s1) to enable the correction of the paper position; in this state, the current paper deviation amount is measured by the line sensor 25 and the resist rollers 20 are shaken in accordance with the deviation amount, so that the paper position is corrected (Step s2). On this occasion, the home position of the paper position may be corrected depending on the deviation tendency or the like.

In this example, the correction is conducted once; however, the operation of measuring the deviation amount again after the correction and then conducting the correction may be repeated a plurality of times.

The correction may be conducted every time the print is started; however, instead of every time the print is started, the correction may be conducted only after the roll is exchanged or only when the abnormality has occurred to cause the apparatus to stop, etc. In the case of correcting the paper position by the resist rollers, the characteristic of the change of the roll paper deviation amount is changed; therefore, the paper position accumulation data for the position prediction are initialized.

Next, the history of the paper position coordinates stored in the HDD 119 and the like is completely deleted and variation period=max, paper size=fed roll paper size, period counter=0, and characteristic value=no characteristic are set (Step s3). After Step s3, the crimp of the paper by the crimp conveyance unit on the conveyance paths 22 and 23 is made effective (Step s4) and the operation of feeding the roll paper is started (Step s5).

After the start of the paper feed operation, the current paper position is measured for every certain period in the paper conveyance; based on the measurement result, the paper position for the next transfer timing is predicted (Step s6). For the criterion of the period for measuring the paper position, the time, the conveyance distance, and the like are given. Next, whether it is the time to start the image formation or not is determined (Step s7), and if it is not the time to start the image formation (No in Step s7), the process advances to Step s8 of determining whether the print is completed or not. If it is the time to start the image formation (Yes in Step s7), the result of predicting the paper position prediction is reflected in the image writing start position and the development is started (Step s10). If the development has been completed (Yes in Step s11), whether it is the time to transfer is determined (Step s12). If the development has not been completed yet, the completion of the development is awaited (No in Step s11). If it is the time to transfer (Yes in Step s12), the developed image is transferred to the paper (Step s13) and whether the print has been completed or not is determined (Step s8). If it is not the time to transfer, the timing of transfer is awaited (No in Step s12).

If it has been determined that the print is completed (Yes in Step s8), the print operation is ended; if it has been determined that the print is not yet completed (No in Step s8), whether a certain period has passed since the previous measurement of the paper position is determined (Step s9). If a certain period has passed since the previous measurement of the paper position (Yes in Step s9), the process returns to Step s6, and the paper position prediction is conducted. If a certain period has not passed since the previous measurement of the paper position (No in Step s9), the process shifts to Step s7, and whether it is the time to form an image or not is determined.

Figure 6:
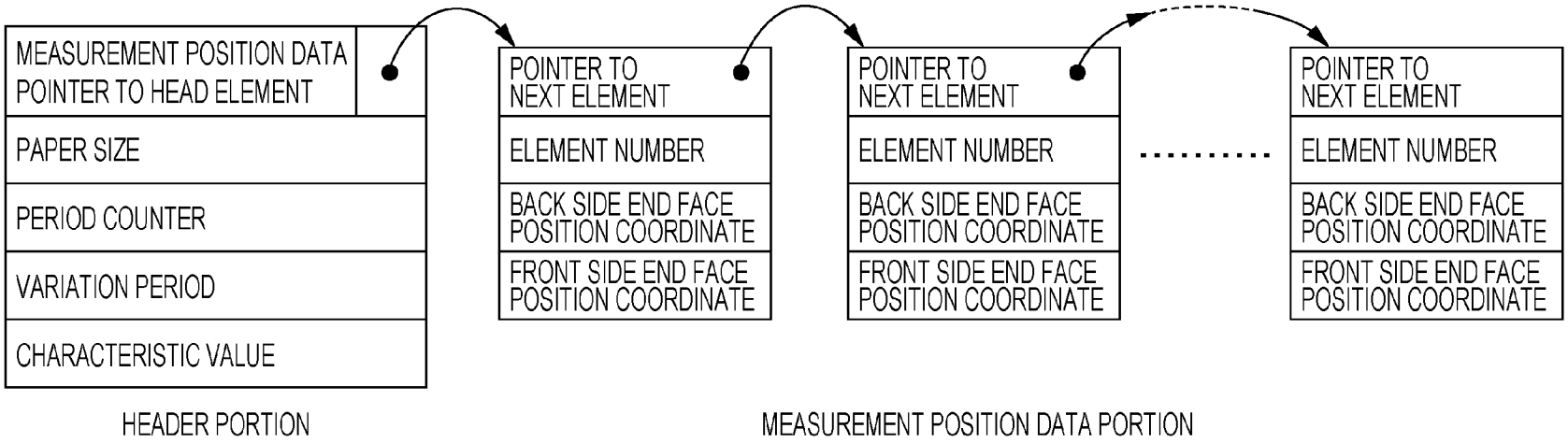
FIG. 6 is a diagram showing a configuration of the storage of the paper position accumulation data.

A configuration of the paper position accumulation data is described with reference to FIG. 6. The paper position accumulation data are stored in the nonvolatile memory 115, the HDD 119, and the like.

The paper position accumulation data include, as a header part, the data including the pointer to the head element of the measurement position data, the paper size, the period counter, the variation period, and the characteristic value. Each configuration is described below.

<Header Part>

Pointer to the head element of the measurement position data: pointer storing the address of the head element of the list configuration. A null pointer representing the data are absent is set as the default.

Paper size: the paper size used as a reference when the deviation amount is calculated from the results of measuring the end face position of the paper. The roll paper size input by the user is set as the default.

Period counter: the value of managing the count number until the characteristic changes if the deviation direction changes in the same direction continuously. The default is 0. The period counter in FIG. 6 does not distinguish the counter/variation period in the front/back direction; however, the counter/variation period can have the parameters individually set and can be managed as the different variation periods.

Variation period: the value of managing at what period the characteristic of the previous continuous change has turned into another characteristic. The prediction is carried out mainly at the previous variation period but the prediction is conducted with the average values from the latest M times. A structure can alternatively be employed in which the variation period extremely different from another piece of data is eliminated. The maximum value that the system can have is set as the default.

Characteristic value: the characteristic value has two statuses of "continuously changing" representing that the change occurs continuously in the same direction; and "no characteristic" representing the other cases. The two statuses may be "continuously changing in the front direction" and "continuously changing in the back direction". The status of "no characteristic" is set as the default.

The measurement position data portion of each element in the measurement position data includes the pointer to the next element, the element number, the back side end face position coordinate, and the front side end face position coordinate. Each element is described below.

<Measurement Position Data Portion>

Pointer to next element: the pointer to the next measurement result data element. If the next data are absent, the pointer is the null pointer.

Element number: the serial number of the data element. Back side end face position coordinate: measured end face position on the back side.

Front side end face position coordinate: measured end face position on the front side.

Figure 7:
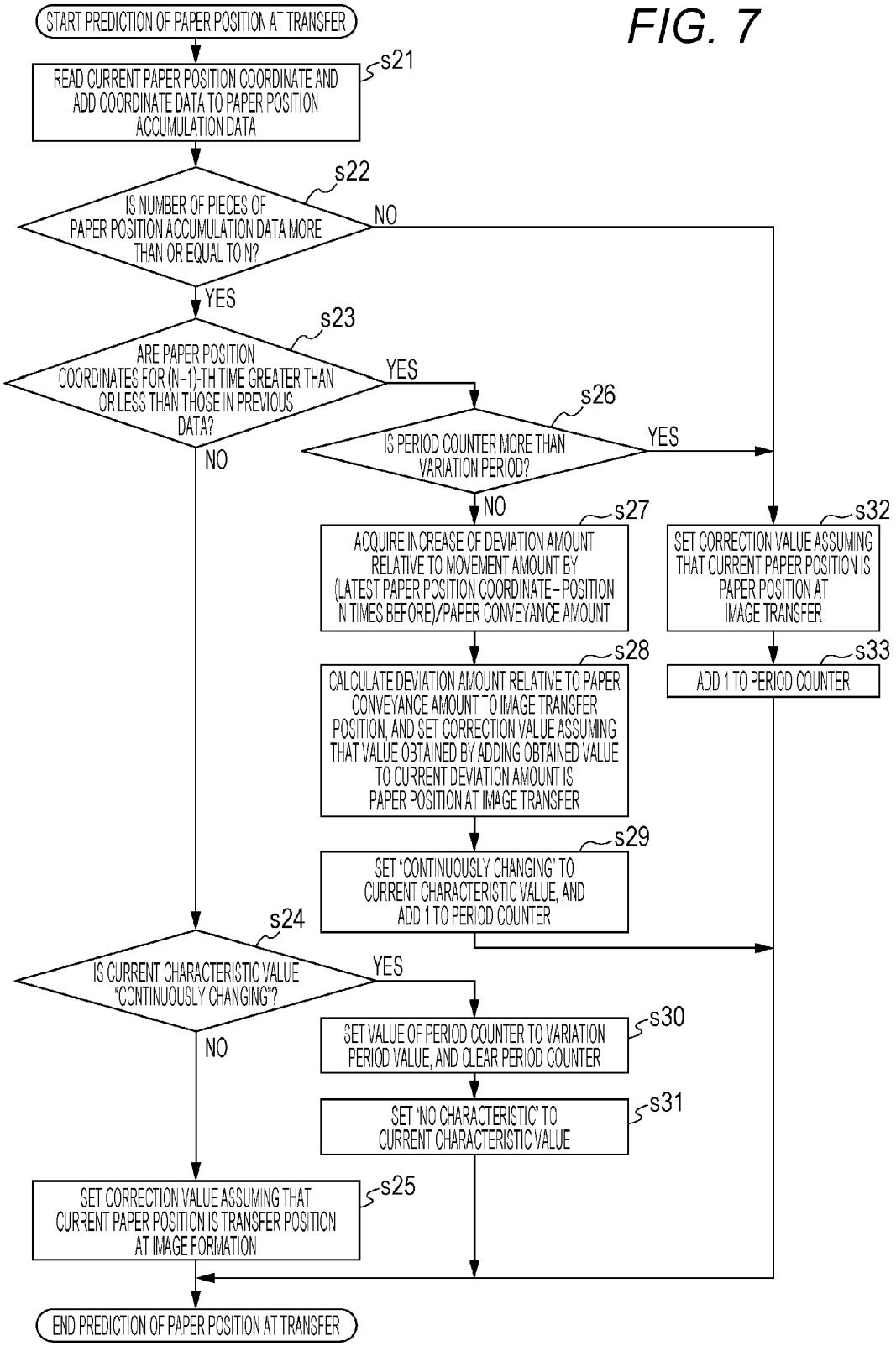
FIG. 7 is a flowchart showing the procedure of measuring the current paper position and predicting the paper position at the timing of the next transfer timing based on the measurement result in the procedure of controlling the deviation correction.

The transfer time paper position prediction procedure of measuring the current paper position and predicting the paper position for the next transfer timing based on the measurement result in the procedure of the deviation correction is specifically described with reference to the flowchart of FIG. 7. The procedure below is executed by the operation of the control CPU 113.

The line sensor 25 reads the current paper position coordinate and adds the coordinate data as the head element to the paper position accumulation data stored in the nonvolatile memory 115 or the HDD 119 (Step s21).

Next, whether the number of pieces of paper position coordinate data is more than or equal to N is determined. The numeral of N is set in advance and stored in the nonvolatile memory 115 or the like. The numeral may be set as default or may be set by an operator through the operation display unit 140. If the number of pieces of data is less than N, the characteristic cannot be acquired and the prediction accuracy becomes low; thus, the correction can be conducted using the current position as the paper position at the transfer. As the numeral of N, the numeral as the preferable and appropriate number of pieces of accumulation data for observing the variation can be set.

The image formation can be avoided until the number of pieces of data becomes more than or equal to N, or the prediction can be conducted based on the past data/manually registered data.

If the number of pieces of paper position accumulation data is more than or equal to N (Yes in Step s22), whether the paper position coordinates for the latest (N−1)-th time are greater than the coordinate of the previous piece of data is determined (Step s23). In this case, it is desirable that whether all the coordinates of the back side end face position coordinate and the front side end face position coordinate are greater than the coordinates in the previous piece of data is determined. If the number of pieces of paper position accumulation data is not greater than or equal to N (No in Step s22), the correction value is set assuming that the current paper position is the paper position at the image transfer (Step s32), 1 is added to the period counter (Step s33), and the paper position prediction for the next transfer is ended.

If all the paper position coordinates for the latest (N−1)-th time is greater than or less than the coordinates of the previous piece of data in step s23 (Yes in Step s23), it is determined that the coordinate changes constantly in a certain direction. Instead of determining the paper position by one measurement value in measuring the paper position, the paper position can be calculated by averaging the measurement values for M times (N>M) in consideration of the variation and error of the line sensor 25. Thus, the pieces of data with a drastically different tendency can be eliminated. In this case, it is determined that the change in a certain direction occurs as long as the average of the measurement values has a change in the certain direction even if a part of the measurement values has a change (increase or decrease) not in the certain direction.

Next, whether the value of the period counter is greater than the variation period value or not is determined (Step s26). Since the roll paper sometimes meanders, the change direction is switched at a certain period. Thus, even if the change continues in the same direction, it is predicted that the characteristic value is "no characteristic" as long as the value of the period counter is more than the variation period value (Yes in Step s26). Therefore, the correction value is set assuming that the current paper position is the paper position at the image transfer (Step s32) and 1 is added to the period counter (Step s33) and the paper position prediction at the next transfer is ended.

In Step s26, if the value of the period counter is not more than the variation period value (No in Step s26), the increase of the deviation amount relative to the movement amount is acquired by the calculation of (latest paper position coordinate−position N times before)/(paper conveyance amount) (Step s27), the deviation amount relative to the paper conveyance amount to the image transfer position is calculated, and the value obtained by adding the calculated value to the current deviation amount is set to the correction value as the paper position at the image transfer (Step s28). If the characteristic is "continuously changing", it is predicted that the paper position will continue to change in the same direction; thus, the change amount in the case where the paper is conveyed to the transfer position is calculated from the change amount in the section, and the paper position at the transfer can be predicted. Next, "continuously changing" is set to the current characteristic value and 1 is added to the period counter (Step s29) and the paper position prediction for the next transfer is ended.

If it is not determined that all the paper position coordinate for the latest (N−1)-th time is greater than or less than the coordinates in the previous data (No in Step s23), i.e., the paper position coordinates for the latest (N−1)-th time have not changed in the certain direction, whether the current characteristic value "continuously changing" or not is determined (Step s24).

If the current characteristic value is "continuously changing" (Yes in Step s24), the value of the period counter is set to the variation period value and the period counter is initialized to 0 (Step s30), the current characteristic value is set to "no characteristic" (Step s31), and the paper position prediction for the next transfer is ended. In other words, if the measurement results indicate that the movement direction is different in the "continuously changing", it is determined that the characteristic has turned from "continuously changing" to "no characteristic".

If the current characteristic value is not "continuously changing" in Step s24 (No in Step s24), the correction value is set assuming that the current paper position is the transfer position at the image formation (Step s25), and the paper position prediction for the next transfer is ended.

In the procedure of this embodiment, whether all the paper position information for the latest (N−1)-th time is greater than or less than the information in the previous data is determined. However, if the change does not occur in the certain direction but the change occurs in paper deviating directions that vary periodically, the average value of the change amount of the conveyance distance or the paper position that changes continuously in the same direction is used; by predicting the timing at which the paper position of the continuous paper changes, the paper position at the image formation may be set to the correction value.

Figure 8:
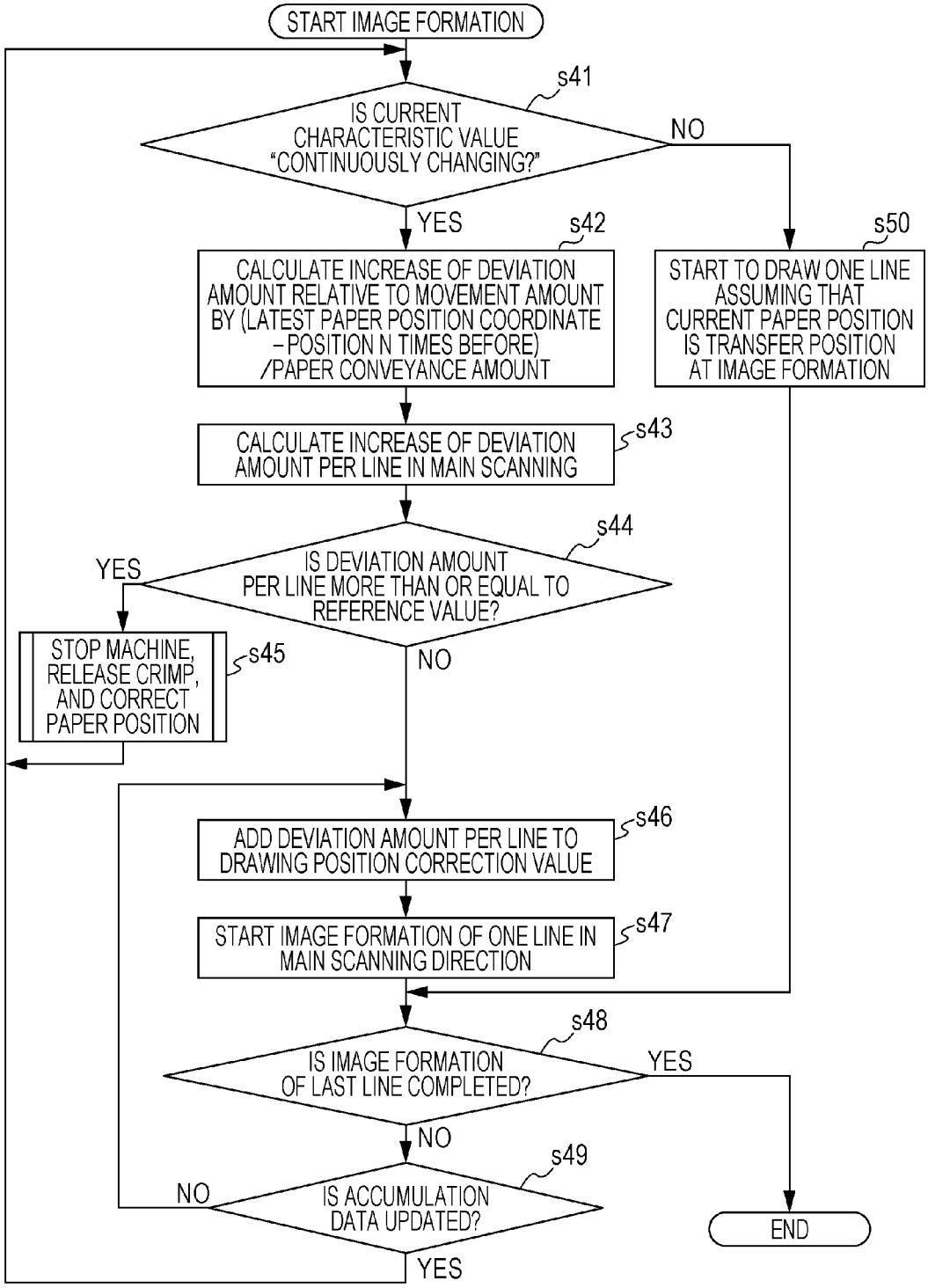
FIG. 8 is a flowchart showing the procedure of reflecting the result of predicting the paper position in the image writing start position and developing.

The procedure of the image formation in which the result of the paper position prediction is reflected in the image writing start position and then the development is performed is specifically described with reference to the flowchart of FIG. 8. The procedure below is executed by the operation of the control CPU 113.

The image formation procedure is started and whether the current characteristic value "continuously changing" is determined. If the current characteristic value is not "continuously changing" (No in Step s41), the drawing of one line in a main scanning is started (Step s50) assuming that the current paper position is the transfer position at the image formation, and then, whether the image formation in the last line has been completed or not is determined (Step s48).

If the current characteristic value is "continuously changing" (Yes in Step s41), (latest paper position coordinate–position N times before)/(paper conveyance amount) is calculated as the increase of the deviation amount relative to the movement amount (Step s42), thereby calculating the increase of the deviation amount for each line in a main scanning (Step s43). In other words, the change amount per unit length is obtained from the length and the change amount in the section where the change continues, the change amount for each line in a main scanning is calculated and the calculated value is added to the correction value of the image position for each line; thus, the image formation can be carried out.

In this embodiment, the deviation amount per line is calculated but the deviation amount for a plurality of lines may be calculated.

Whether the deviation amount per line in a main scanning is more than or equal to the reference value or not is determined (Step s44), and if the deviation amount per line in a main scanning is more than or equal to the reference value (Yes in Step s44), the machine is stopped and the crimp of the crimp conveyance unit is released and the paper position correction by the shake of the resist rollers 20 is carried out (Step s45). Note that at least one of these steps may be performed and the other steps may be ordered by a user.

If the deviation amount per line in a main scanning is not more than or equal to the reference value (No in Step s44), the deviation amount per line in a main scanning is added to the drawing position correction value (Step s46), the image formation for one line in a main scanning is started (Step s47) and whether the image formation of the last line has been completed or not is determined (Step s48).

If the image formation of the last line has been completed (Yes in Step s48), the process is ended. If the image formation of the last line has not been completed (No in Step s48), whether the accumulation data have been updated or not is determined (Step s49). If a new piece of data is added before the image formation for the next line is started and the accumulation data are updated (Yes in Step s49), the process returns to Step s41 and the image formation operation is carried out based on the latest paper position prediction. If the accumulation data have not been updated (No in Step s49), the process returns to Step s46 and the deviation amount per line in a main scanning is added to the drawing position correction value, and the subsequent steps are conducted.

Note that if the deviation amount per line in a main scanning is more than or equal to the reference value, the operation display unit may display warning to induce the user to correct the paper position.

The present invention has been described based on the embodiment as above; however, the present invention is not limited to the above embodiment and various changes can be made within the scope of the present invention.

According to an embodiment of the present invention, the position can be corrected in either circumstances of during the stop of the paper feed operation or during the paper feed operation in the case where the image is formed on the continuous paper such as the roll paper, and the image can be formed on the paper at excellent position accuracy.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image formation apparatus comprising:

an image formation unit that forms an image on continuous paper;

a paper conveyance unit that conveys the continuous paper in a conveyance direction through a conveyance path;

a deviation correction unit that corrects a deviation of the continuous paper by moving the continuous paper on the conveyance path in a transverse direction perpendicular to the conveyance direction;

a paper position measurement unit that measures a paper position in the transverse direction of the continuous paper on the conveyance path; and a control unit that controls the image formation unit and the deviation correction unit, wherein during a stop of a conveyance operation of the paper conveyance unit, the control unit receives a measurement result from the paper position measurement unit and controls the deviation correction unit to perform deviation correction by moving the continuous paper to a predetermined position in the transverse direction based on the measurement result, and during the conveyance operation of the paper conveyance unit, the control unit receives the measurement result from the paper position measurement unit and determines an image formation position in a main scanning direction for performing the image formation based on the measurement result.

2. The image formation apparatus according to claim 1, wherein:

the paper conveyance unit comprises a crimp conveyance unit that conveys the continuous paper while crimping the continuous paper in the conveyance operation and that is capable of releasing the crimp of the continuous paper, and the control unit controls the crimp conveyance unit to release the crimp of the continuous paper during the deviation correction during the stop of the conveyance operation.

3. The image formation apparatus according to claim 1, wherein:

the paper position measurement unit is configured to measure the paper position of the continuous paper in the transverse direction periodically, and the control unit predicts a paper position at image formation based on a characteristic of the paper position measured periodically in the conveyance operation of the continuous paper, and determines the image formation position in the main scanning direction based on the predicted paper position.

4. The image formation apparatus according to claim 3, wherein when the paper position of the continuous paper measured periodically changes continuously in a same direction, the control unit predicts the paper position of the continuous paper based on an average value of a change amount of the paper position for every predetermined period, and determines the image formation position in the main scanning direction based on the predicted paper position.

5. The image formation apparatus according to claim 3, wherein when the paper position of the continuous paper measured periodically does not change continuously in a same direction, the control unit determines the image formation position in the main scanning direction assuming that a current paper position is the paper position at the image formation.

6. The image formation apparatus according to claim 1, wherein the control unit uses an average obtained from measuring paper positions a plurality of times to determine the paper position of the continuous paper in the transverse direction.

7. The image formation apparatus according to claim 3, further comprising a storage unit that stores data related to the paper position measured by the paper position measurement unit.

8. The image formation apparatus according to claim 7, wherein when the continuous paper conveyed by the paper conveyance unit is exchanged, the control unit clears the data related to the paper position of the continuous paper stored in the storage unit.

9. The image formation apparatus according to claim 7, wherein when the paper position of the continuous paper has been moved by the deviation correction unit during the stop of the conveyance operation, the control unit clears the data related to the paper position of the continuous paper stored in the storage unit.

10. The image formation apparatus according to claim 1, wherein during the conveyance operation, the control unit obtains measurement data related to the paper position measured by the paper position measurement unit for each drawing line in the main scanning direction, averages the measurement data in a predetermined detection period, and decides the image formation position in the main scanning direction in accordance with the measurement data averaged for each drawing line.

11. The image formation apparatus according to claim 10, wherein the control unit determines that an abnormality has occurred if measurement data obtained by averaging based on one drawing line is greater than a predetermined reference value.

12. The image formation apparatus according to claim 11, wherein upon the determination of the abnormality, the control unit performs at least one of (i) a stop of the conveyance operation, (ii) a notification process to warn a user of the abnormality, and (iii) control to cause the deviation correction unit to perform the deviation correction of the continuous paper during the stop of the conveyance operation.

* * * * *